US011594391B2

(12) United States Patent
Channakesavelu et al.

(10) Patent No.: US 11,594,391 B2
(45) **Date of Patent: *Feb. 28, 2023**

(54) ACTIVE/PASSIVE FUSE MODULE

(71) Applicants: Littelfuse International Holding, LLC., Chicago, IL (US); Astotec Automotive GmbH, Hirtenberg (AT)

(72) Inventors: Ganesh Nagaraj Channakesavelu, Rolling Meadows, IL (US); Engelbert Hetzmannseder, Klosterneuburg (AT); Peter Pöltl, Hirtenberg (AT); Derek Lasini, Park Ridge, IL (US)

(73) Assignees: LITTELFUSE INTERNATIONAL HOLDING, LLC., Chicago, IL (US); ASTOTEC AUTOMOTIVE GMBH, Hirtenberg (AT)

( * ) Notice: Subject to any disclaimer, the term of this patent is extended or adjusted under 35 U.S.C. 154(b) by 0 days.

This patent is subject to a terminal disclaimer.

(21) Appl. No.: 17/380,436

(22) Filed: Jul. 20, 2021

(65) Prior Publication Data

US 2021/0350994 A1 Nov. 11, 2021

Related U.S. Application Data

(63) Continuation-in-part of application No. 17/021,774, filed on Sep. 15, 2020, now Pat. No. 11,387,068.
(Continued)

(51) Int. Cl.
*H01H 85/041* (2006.01)
*H01H 85/02* (2006.01)
*H01H 39/00* (2006.01)

(52) U.S. Cl.
CPC ..... *H01H 85/041* (2013.01); *H01H 39/00* (2013.01); *H01H 85/0241* (2013.01)

(58) Field of Classification Search
CPC .. H01H 85/041; H01H 39/00; H01H 85/0241; H01H 2085/466; H01H 85/10; H01H 39/006; H01H 85/46
See application file for complete search history.

(56) References Cited

U.S. PATENT DOCUMENTS 3,938,067 A * 2/1976 Fister ..... H01H 85/0456 337/159
6,483,420 B1 * 11/2002 Takahashi ..... H01H 85/044 361/45

(Continued)

FOREIGN PATENT DOCUMENTS

DE 3243892 A1 7/1983
DE 202015106793 U1 * 2/2016 ..... H01H 39/006
WO 2019043807 A1 3/2019

OTHER PUBLICATIONS

"Schmelzsicherung", Jan. 14, 2016, Kromberg & Schubert Gmbh, Entire Document (Translation of DE 202015106793). (Year: 2016).*

(Continued)

*Primary Examiner* — Stephen S Sul
(74) *Attorney, Agent, or Firm* — KDB Firm PLLC

(57) ABSTRACT

An active/passive fuse module including a base, a busbar disposed on the base and including a fuse element extending over a cavity in a top surface of the base and having a plurality of weak points formed therein, a pyrotechnic interrupter (PI) disposed atop the base and including a piston disposed within a shaft above the fuse element, the piston having an edge with a geometry that corresponds to a geometry of a pattern defined by the weak points in the fuse element, a first pyrotechnic ignitor coupled to a controller and configured to detonate and force the piston through the fuse element upon receiving an initiation signal from the controller, and a second pyrotechnic ignitor coupled to the busbar by a pair of leads and configured to detonate and (Continued)

force the piston through the fuse element upon an increase in voltage across the leads.

7 Claims, 6 Drawing Sheets

Related U.S. Application Data

(60) Provisional application No. 63/036,613, filed on Jun. 9, 2020, provisional application No. 62/948,728, filed on Dec. 16, 2019.

(56) References Cited

U.S. PATENT DOCUMENTS

| | | | | |
|---|---|---|---|---|
| 9,324,522 | B2 * | 4/2016 | Nakamura | H01H 39/006 |
| 10,693,363 | B1 * | 6/2020 | White | H02M 1/32 |
| 11,387,068 | B2 * | 7/2022 | Schlaak | H01H 85/0039 |
| 2014/0061161 | A1 * | 3/2014 | Nakamura | H01H 39/006 218/46 |
| 2016/0189897 | A1 * | 6/2016 | Hasunuma | H01H 85/048 337/401 |
| 2017/0076890 | A1 * | 3/2017 | Hori | B60L 3/0007 |
| 2019/0108957 | A1 * | 4/2019 | Volkmann | B60L 3/04 |
| 2019/0244778 | A1 * | 8/2019 | Dariavach | H02H 3/08 |
| 2019/0287751 | A1 * | 9/2019 | Gonthier | H01H 85/0241 |
| 2020/0279711 | A1 * | 9/2020 | Mathieu | H01H 85/0039 |
| 2021/0183607 | A1 | 6/2021 | Schlaak | |

OTHER PUBLICATIONS

International Search Report and Written Opinion dated Oct. 28, 2022 for Corresponding application PCT/US2022/37682 filed Jul. 20, 2022.

* cited by examiner

ACTIVE/PASSIVE FUSE MODULE

CROSS-REFERENCES TO RELATED APPLICATIONS

This application is a continuation-in-part of U.S. Non-Provisional patent application Ser. No. 17/021,774, filed Sep. 15, 2020, which claimed the benefit of U.S. Provisional Patent Application No. 62/948,728, filed Dec. 16, 2019 and U.S. Provisional Patent Application No. 63/036,613, filed Jun. 9, 2020, which applications are incorporated by reference herein in their entireties.

FIELD OF THE DISCLOSURE

This disclosure relates generally to the field of circuit protection devices and relates more particularly to an active/passive fuse module that includes both passive and active circuit protection elements.

BACKGROUND OF THE DISCLOSURE

Fuses are commonly implemented in electrical systems for providing overcurrent protection. Most fuses are "passive" devices that include fuse elements that are configured to carry a rated amount of electrical current during normal operation. If current flowing through a fuse element exceeds the fuse element's rated current, the fuse element will melt, disintegrate, or otherwise separate, thereby arresting the current to prevent or mitigate damage to connected electrical components.

In some cases, it may be desirable to "actively" create a physical opening in an electrical circuit regardless of an amount of electrical current flowing through the circuit. For example, if an automobile is involved in a collision, it may be desirable to physically open an electrical circuit in the automobile to ensure that connected electrical components are deenergized to mitigate the risk of fire and/or electrocution in the aftermath of the collision. To that end, so-called pyrotechnic interrupters (PIs) have been developed which can be selectively actuated upon the occurrence of specified events to interrupt the flow of current in a circuit. For example, in the case of an automobile collision, a controller (e.g., an airbag control unit, battery management system, etc.) may send an initiation signal to a PI, causing a pyrotechnic ignitor within the PI to be detonated. A resultant increase in pressure within the PI rapidly forces a piston or blade to cut through a conductor that extends through the PI. Electrical current flowing through the PI is thereby interrupted, and the piston, which is formed of a dielectric material, provides an electrically insulating barrier between separated portions of the conductor to prevent electrical arcing therebetween.

In certain applications it may be desirable to implement both passive and active circuit protection elements. It may further be desirable to implement such elements in a compact, space-saving form factor that facilitates convenient installation.

It is with respect to these and other considerations that the present improvements may be useful

SUMMARY

This Summary is provided to introduce a selection of concepts in a simplified form further described below in the Detailed Description. This Summary is not intended to identify key features or essential features of the claimed subject matter, nor is the summary intended as an aid in determining the scope of the claimed subject matter.

An active/passive fuse module in accordance with a non-limiting embodiment of the present disclosure may include a base, a busbar disposed on a top surface of the base and including a fuse element and first and second terminal portions extending from opposite ends of the fuse element, the fuse element extending over a cavity in the top surface of the base and having a plurality of weak points formed therein, a pyrotechnic interrupter (PI) disposed atop the base, the PI including a piston disposed within a shaft above the fuse element, the piston having an edge with a geometry that corresponds to a geometry of a pattern defined by the weak points in the fuse element, a first pyrotechnic ignitor coupled to a controller, the first pyrotechnic ignitor configured to detonate and force the piston through the fuse element upon receiving an initiation signal from the controller, and a second pyrotechnic ignitor coupled to the busbar by a pair of leads, the second pyrotechnic ignitor configured to detonate and force the piston through the fuse element upon an increase in voltage across the leads.

An active/passive fuse module in accordance with another non-limiting embodiment of the present disclosure may include an electrically insulating base, a busbar disposed on a top surface of the base and comprising a fuse element and first and second terminal portions extending from opposite ends of the fuse element, the fuse element extending over a cavity formed in the top surface of the base and having a plurality of weak points formed therein, a pyrotechnic interrupter (PI) disposed atop the base, the PI including a piston disposed within a shaft above the fuse element, the piston having an edge with a geometry that corresponds to a geometry of a pattern defined by the weak points in the fuse element, a current sensing module connected to the busbar and configured to measure a current flowing through the busbar, and a pyrotechnic ignitor coupled to a controller and to the current sensing module, wherein the pyrotechnic ignitor is configured to detonate and force the piston through the fuse element upon receiving an initiation signal from at least one of the controller and the current sensing module.

An fuse module in accordance with another non-limiting embodiment of the present disclosure may include a base, a busbar disposed on a top surface of the base and including a fuse element and first and second terminal portions extending from opposite ends of the fuse element, the fuse element extending over a cavity in the top surface of the base and having a plurality of weak points formed therein, a pyrotechnic interrupter (PI) disposed atop the base, the PI including a piston disposed within a shaft above the fuse element, the piston having an edge with a geometry that corresponds to a geometry of a pattern defined by the weak points in the fuse element, a first pyrotechnic ignitor coupled to a controller, and a pyrotechnic ignitor coupled to the busbar by a pair of leads, the pyrotechnic ignitor configured to detonate and force the piston through the fuse element upon an increase in voltage across the leads.

DETAILED DESCRIPTION

An active/passive fuse module in accordance with the present disclosure will now be described more fully with reference to the accompanying drawings, in which preferred embodiments of the active/passive fuse module are presented. It will be understood, however, that the active/passive fuse module may be embodied in many different forms and should not be construed as being limited to the embodiments set forth herein. Rather, these embodiments are provided so that this disclosure will convey certain exemplary aspects of the active/passive fuse module to those skilled in the art.

Figure 1:
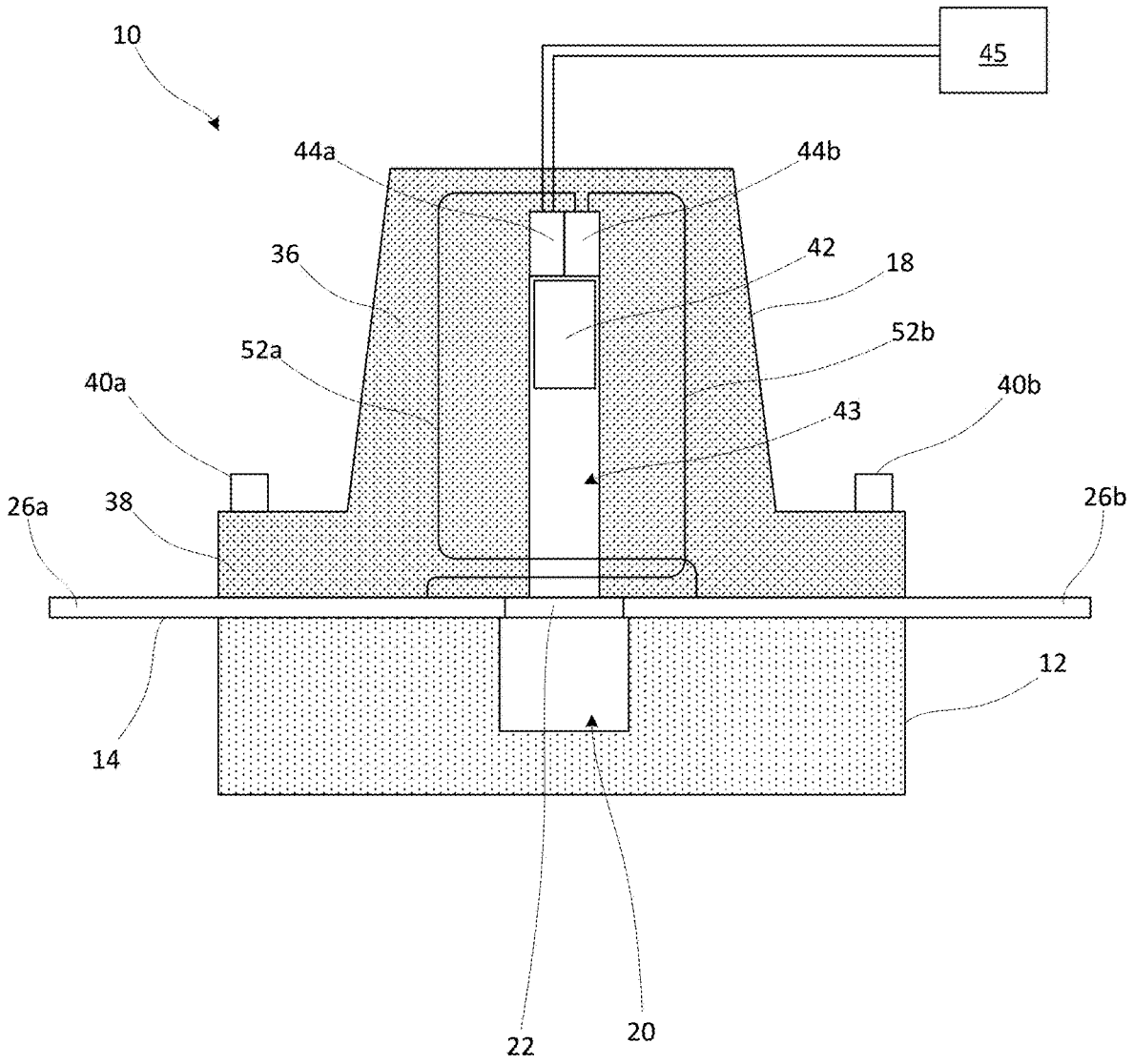
FIG. 1 is a cross sectional view illustrating an embodiment of an active/passive fuse module in accordance with the present disclosure in a non-actuated state.
Figure 2:
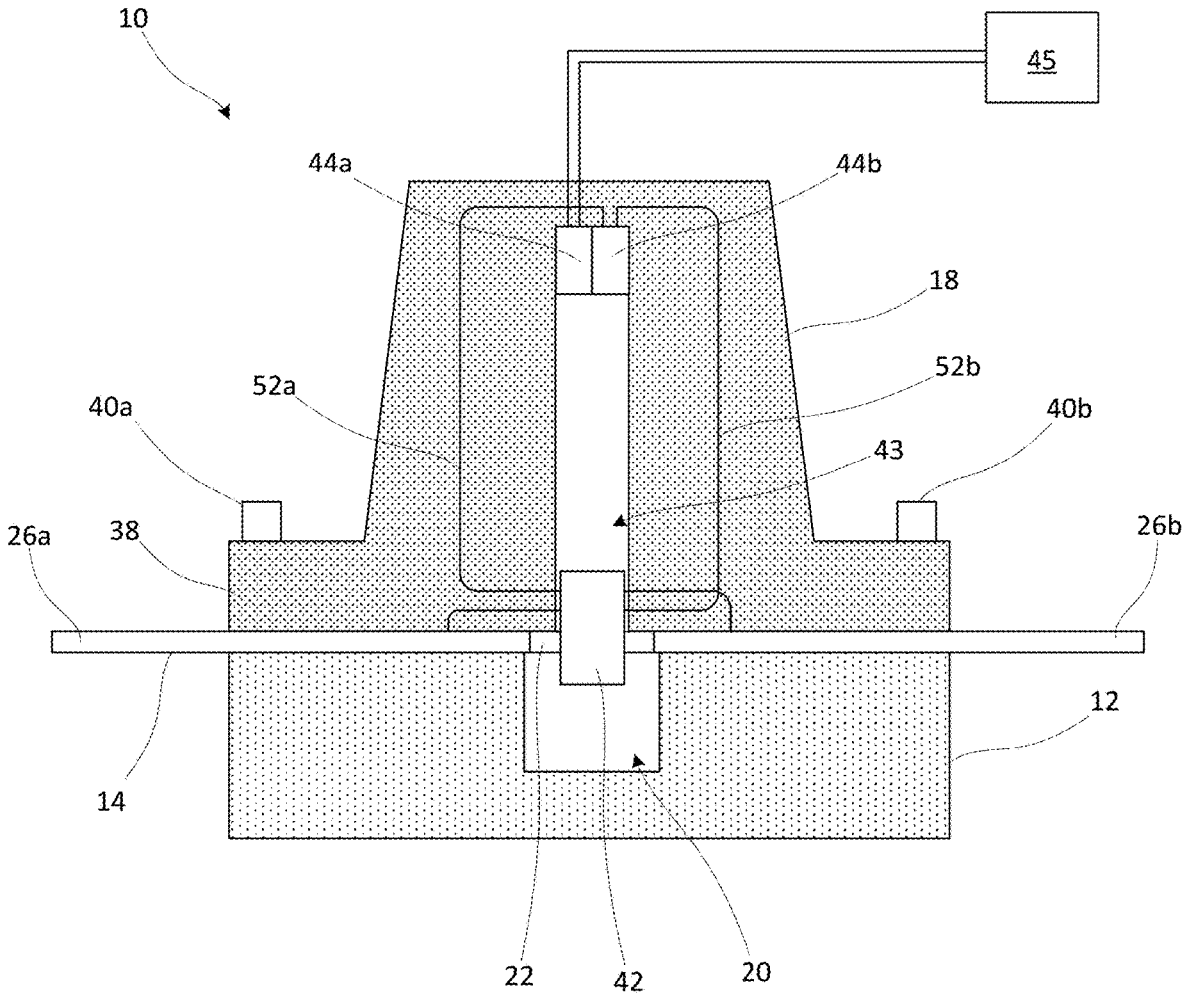
FIG. 2 is a cross sectional view illustrating the active/passive fuse module shown in FIG. 1 in an actuated state.

Referring to FIGS. 1 and 2, cross-sectional views illustrating an active/passive fuse module 10 (hereinafter "the fuse module 10") in accordance with an exemplary, non-limiting embodiment of the present disclosure are shown. For the sake of convenience and clarity, terms such as "front," "rear," "top," "bottom," "up," "down," "vertical," and "horizontal" may be used herein to describe the relative placement and orientation of various components of the fuse module 10, each with respect to the geometry and orientation of the fuse module 10 as it appears in FIGS. 1 and 2. Said terminology will include the words specifically mentioned, derivatives thereof, and words of similar import.

The fuse module 10 may generally include a base 12, a busbar 14, and a pyrotechnic interrupter (PI) 18. The base 12 may be formed electrically insulating material, such as plastic, polymer, ceramic, etc. The present disclosure is not limited in this regard. The base 12 may include a cavity 20 formed in a top surface thereof.

The busbar 14 may be formed from a single piece or length of conductive material (e.g., stamped from a single sheet of copper or the like) and may include a fuse element 22 and first and second terminal portions 26*a*, 26*b* extending from opposite ends of the fuse element 22. The busbar 14 may be disposed on the top surface of the base 12 in a horizontal orientation with the fuse element 22 extending over the cavity 20. The first and second terminal portions 26*a*, 26*b* may extend outside of, or beyond, the sides of the base 12 for facilitating connection of the fuse module 10 within a circuit.

The fuse element 22 may be configured to melt, disintegrate, or otherwise open if current flowing through the busbar 14 exceeds a predetermined threshold, or "current rating," of the fuse module 10. In various examples, the fuse element 22 may include perforations, slots, thinned or narrowed segments, and/or various other features for making the fuse element 22 more susceptible to melting or opening than other portions of the busbar 14. In a non-limiting example, the fuse element 22 may be configured to have a current rating in a range between 30 amps and 1000 amps. The present disclosure is not limited in this regard.

The PI 18 may include a housing 36 having a mounting flange 38 projecting from a lower portion thereof. The housing 36 may be disposed atop the base 12 with mechanical fasteners 40*a*, 40*b* extending through the mounting flange 38 and into the base 12 for fastening the components together in a vertically stacked relationship. The housing 36 may include a hollow, vertically oriented shaft 43 extending therethrough. The shaft 43 may have an open bottom end located directly above the fuse element 22 and the cavity 20.

The housing 36 may contain a movable piston or blade 42 (hereinafter "the piston 42") disposed within a hollow shaft 43 located above the cavity 20 of the base 12. The housing 36 may further contain a first pyrotechnic ignitor 44*a* disposed within the shaft 43 above the piston 42. The first pyrotechnic ignitor 44*a* may be coupled to a controller 45 (e.g., an airbag control unit, battery management system, etc. of an automobile). Upon the occurrence of a predefined event, such as an automobile collision (i.e., if the fuse module 10 is implemented in an automobile), the controller 45 may send an initiation signal to the pyrotechnic ignitor 44*a*, causing the pyrotechnic ignitor 44 to be detonated. A resultant increase in pressure within the shaft 43 rapidly forces the piston 42 downwardly in the shaft 43, through the fuse element 22 of the busbar 14 as shown in FIG. 2. Electrical current flowing through the busbar 14 is thereby interrupted, and the piston 42, which may be formed of a dielectric material, may provide an electrically insulating barrier between the separated ends of the fuse element 22 to prevent electrical arcing therebetween.

The above-described manner in which the pyrotechnic ignitor 44*b* is triggered (i.e., via the controller 45 sending an initiation signal to the pyrotechnic ignitor 44*b* upon occurrence of a collision, etc.) may be referred to as "external triggering" of the pyrotechnic ignitor 44*b*. In various embodiments, the fuse module 10 may additionally or alternatively include an "arc triggering" capability, wherein a second pyrotechnic ignitor 44*b* may be disposed within the shaft 43 adjacent the first pyrotechnic ignitor 44*a*. A pair of leads 52*a*, 52*b* may extend from the second pyrotechnic ignitor 44*b* to the first and second terminal portions 26*a*, 26*b*, respectively. In various embodiments, the leads 52*a*, 52*b* may extend through/across the shaft 43 below the piston 42. When the fuse element 22 is melted (e.g., upon occurrence of an overcurrent condition), the voltage across the separated first and second terminal portions 26*a*, 26*b* may create sufficient current in the leads 52*a*, 52*b* to cause the second pyrotechnic ignitor 44*b* to be detonated. A resultant increase in pressure within the shaft 43 rapidly forces the piston 42 downwardly in the shaft 43, through the fuse element 22 of the busbar 14 (as described above and as shown in FIG. 2). Additionally, the piston 42 severs the leads 52*a*, 52*b* to eliminate any potential alternative current paths between the first and second terminal portions 26*a*, 26*b*.

The above-described configuration is not intended to be limiting, and it is contemplated that the leads 52*a*, 52*b* may be severed at various locations other than within the shaft 43 and by structures other than the piston 42. For example, instead of extending through the shaft 43, the leads 52*a*, 52*b* may extend through the cavity 20 or elsewhere adjacent the shaft 43. In various embodiments, the leads 52*a*, 52*b* may be located outside of or away from the path of the piston 42 and, instead of being severed directly by the piston 42, may be severed by a shank or protrusion extending from the piston 42 or by an electrical/mechanical structure or device that may be triggered by movement of the piston 42. The present disclosure is not limited in this regard.

Various additional or alternative devices, configurations, and/or arrangements for ensuring electrical isolation between the first and second terminal portions 26*a*, 26*b* after detonation of the second pyrotechnic ignitor 44*b* may be implemented without departing from the scope of the present disclosure.

Since the fuse element 22 begins to separate (e.g., melts) before the pyrotechnic ignitor 44*b* detonates and drives the piston 42, the fuse element 22 is weakened (e.g. partially melted) before the piston 42 is driven therethrough, making it easier for the piston 42 to cut through the fuse element 22. Thus, the fuse element 22 may be thicker/larger (and therefore capable of handling higher currents) than would be possible if the piston 42 were required to break through an unweakened portion of the busbar 14 (i.e., a portion of the busbar 14 other than the partially melted fuse element 22) as in conventional fuse modules incorporating pyrotechnic interrupters.

While the above-described fuse module 10 includes a first pyrotechnic ignitor 44*a* coupled to the controller 45 and a second pyrotechnic ignitor 44*b* coupled to the first and second terminal portions 26*a*, 26*b* of the busbar 14, respectively, embodiments of the present disclosure are contemplated in which the first pyrotechnic ignitor 44*a* and the controller 45 are omitted, and wherein the fuse module 10 includes only a single pyrotechnic ignitor connected to the busbar 14 and configured to be detonated upon separation of the fuse element 22 (as described above with respect to the second pyrotechnic ignitor 44*b*).

Figure 3:
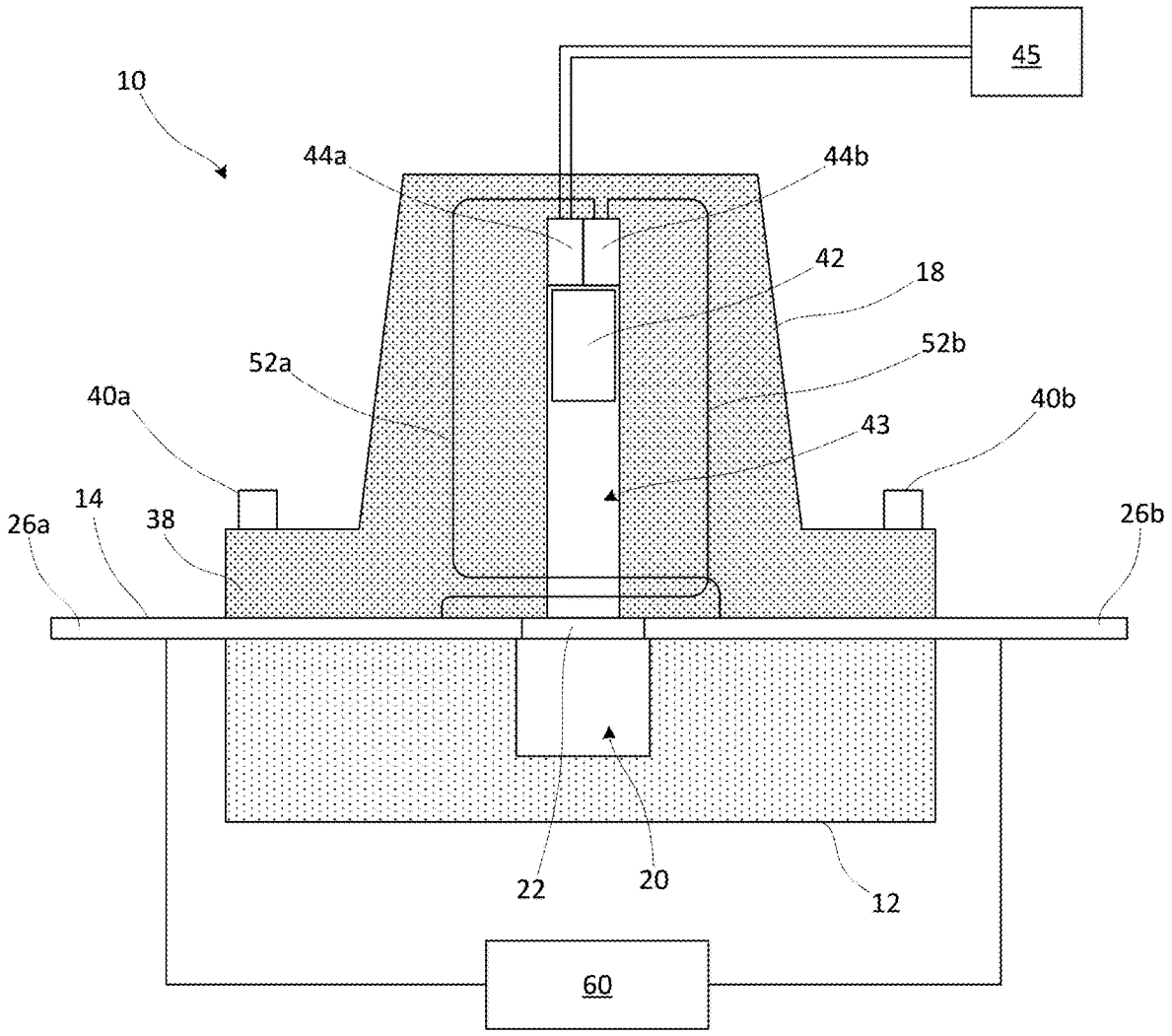
FIG. 3 is a cross sectional view illustrating another embodiment of an active/passive fuse module in accordance with the present disclosure.

Referring to FIG. 3, an embodiment of the present disclosure is contemplated in which a positive temperature coefficient (PTC) element 60 may be connected in parallel with the fuse module 10. The PTC element 60 may be formed of any type of PTC material (e.g., polymeric PTC material, ceramic PTC material, etc.) formulated to have an electrical resistance that increases as the temperature of the PTC element 60 increases. Particularly, the PTC element 60 may have a predetermined "trip temperature" above which the electrical resistance of the PTC element 60 rapidly and drastically increases (e.g., in a nonlinear fashion) in order to substantially arrest current passing therethrough. The PTC element 60 may have, within its normal operating temperature range (i.e., below its trip temperature), a resistance that is greater than a resistance of the fuse element 22.

During normal operation of the fuse module 10, current may flow through the busbar 14, between the first and second terminal portions 26*a*, 26*b*. Upon the occurrence of an overcurrent condition, wherein current flowing through the fuse module 10 exceeds the current rating of the fuse element 22, the fuse element 22 may melt or otherwise separate. The current may then be diverted to flow through the only available alternate path, i.e., through the PTC element 60. Since the current can flow through this alternate path, electrical potential is not able to accumulate between the separated ends of the melted fuse element 22, thereby precluding the formation and propagation of an electrical arc therebetween.

Figure 4:
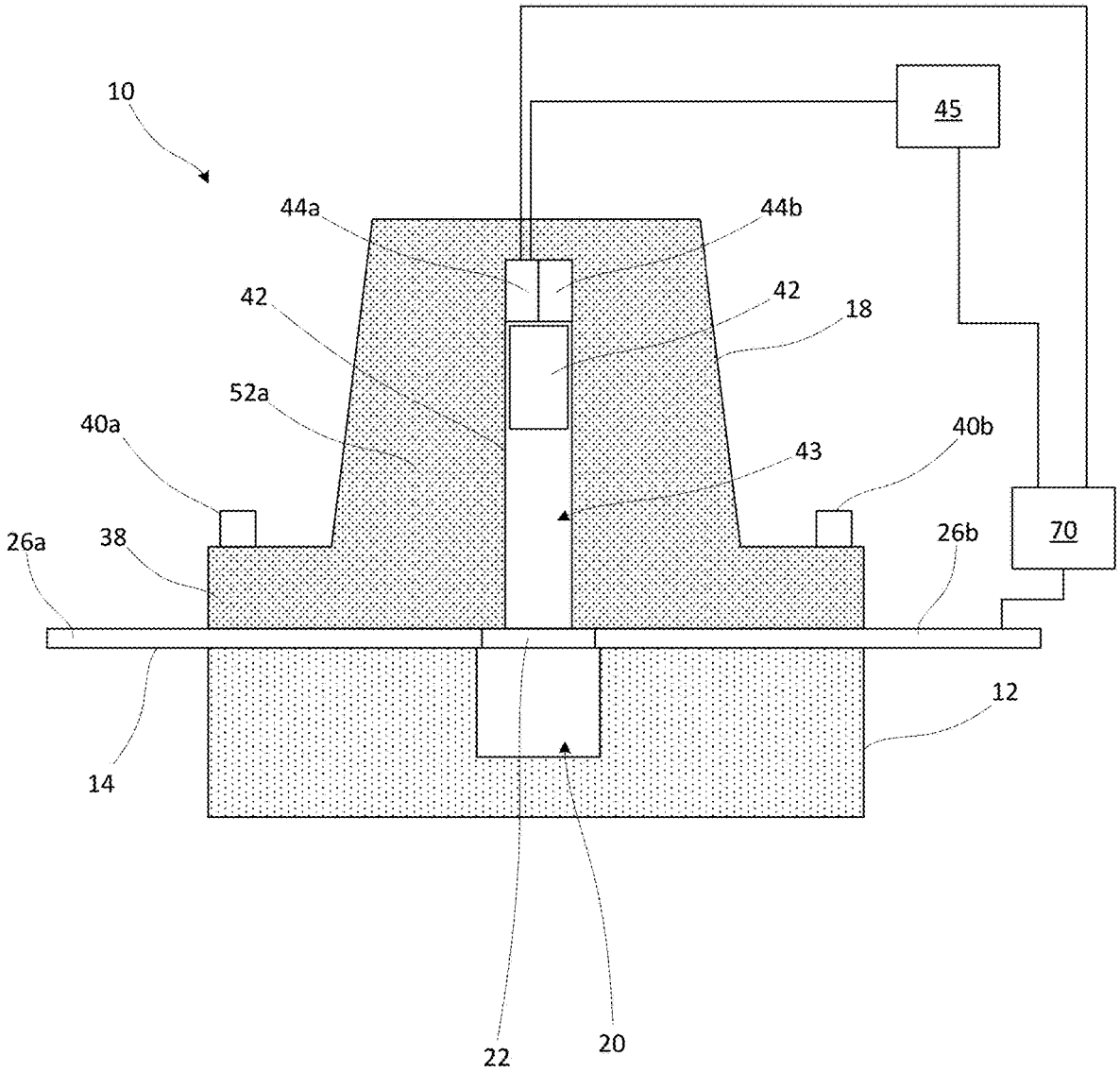
FIG. 4 is a cross sectional view illustrating another embodiment of an active/passive fuse module in accordance with the present disclosure.

Referring to FIG. 4, another embodiment of the present disclosure is contemplated in which a current sensing module 70 (e.g., a current sensor with a microprocessor) may be connected to one of the terminal portions 26*a*, 26*b* of the busbar 14 and to the pyrotechnic ignitor 44*a* of the PI 18. The current sensing module 70 may be configured to measure a current in the busbar 14 and, upon detection of a current above a predefined threshold, may send an initiation signal to the pyrotechnic ignitor 44*a*, detonating the pyrotechnic ignitor 44*a* and breaking the fuse element 22 as described above. The current sensing module 70 may be programmed to send the initiation signal immediately or after a desired, predetermined amount of time (e.g., 10 milliseconds) and in response to detecting a desired, predetermined amount of current in the busbar 14. In various embodiments, the current sensing module 70 may also be connected to the controller 45, and the current sensing module 70 may be configured to send an initiation signal to the pyrotechnic ignitor 44*a* only if certain predetermined conditions are met. For example, the current sensing module 70 may be configured to send an initiation signal to the pyrotechnic ignitor 44*a* if the current sensing module 70 detects more than a predetermined amount of current in the busbar 14 and if the controller 45 provides an indication of a collision to the current sensing module 70. The present disclosure is not limited in this regard.

Figure 5A:
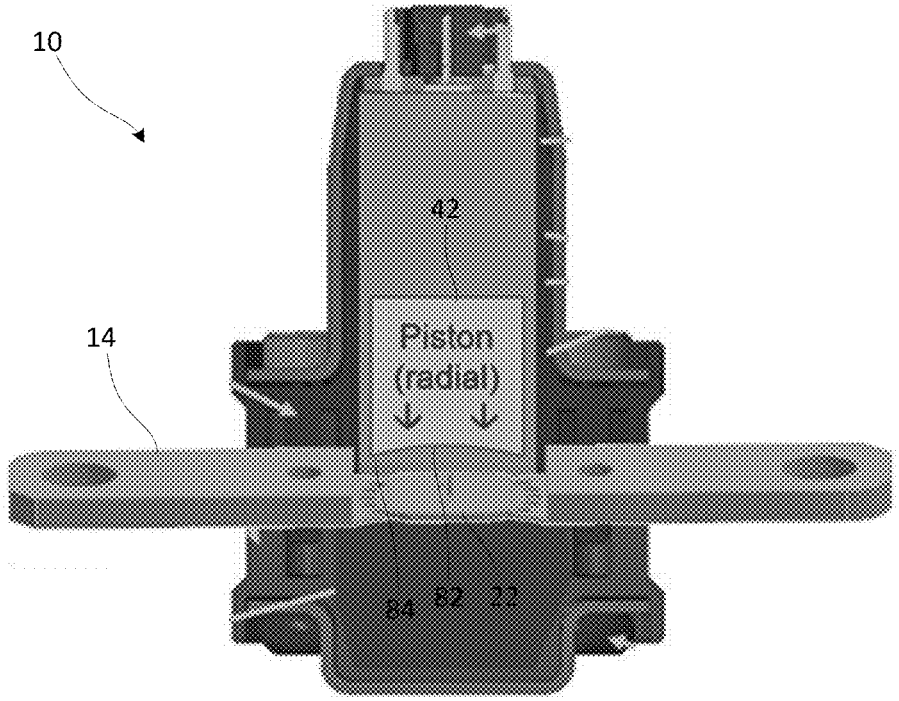
FIG. 5A is a cross sectional view illustrating another embodiment of an active/passive fuse module in accordance with the present disclosure.
Figure 5B:
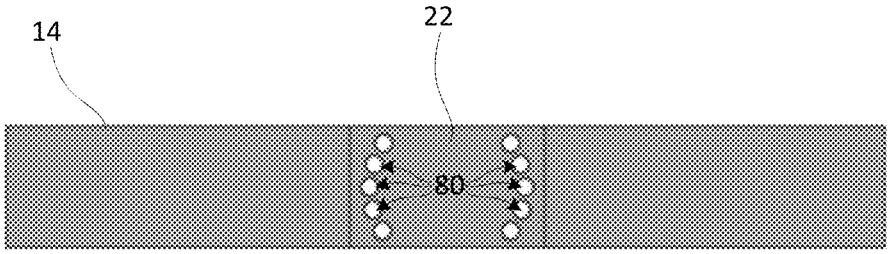
FIG. 5B is a top view illustrating the busbar of the active/passive fuse module shown in FIG. 5A.

Referring to FIG. 5A, another embodiment of the present disclosure is contemplated wherein the fuse element 22 of the busbar 14 may be mechanically weakened for allowing the piston 42 to more readily break through the fuse element 22 (various components of the fuse module 10, such as the leads 52*a*, 52*b*, have been omitted form FIG. 5A for the sake of clarity). Specifically, the fuse element 22 may include a plurality of weak points, wherein a geometry of the weak points corresponds to a geometry of the piston 22. For example, referring to the top view of the busbar 14 shown FIG. 5B, the weak points may be a plurality of perforations 80 formed in the fuse element 22, wherein the perforations are arranged in a generally circular pattern. Referring back to FIG. 5A, the piston 42 may have a concave bottom surface 82 defining a circular, bottom edge 84 that is coaxial with, and that is substantially equal in circumference to, the circular pattern defined by the perforations 80. Thus, when the piston 42 is deployed and engages the fusible element 22, the bottom edge 84 may readily cut through the narrow portions of the fusible element 22 that bridge the perforations 80, ensuring full separation and breakthrough of the fuse element 22. The piston 42 and the busbar 14 shown in FIGS. 5A and 5B can be implemented in any of the fuse module embodiments shown in FIGS. 1-4, for example.

Figure 6A:
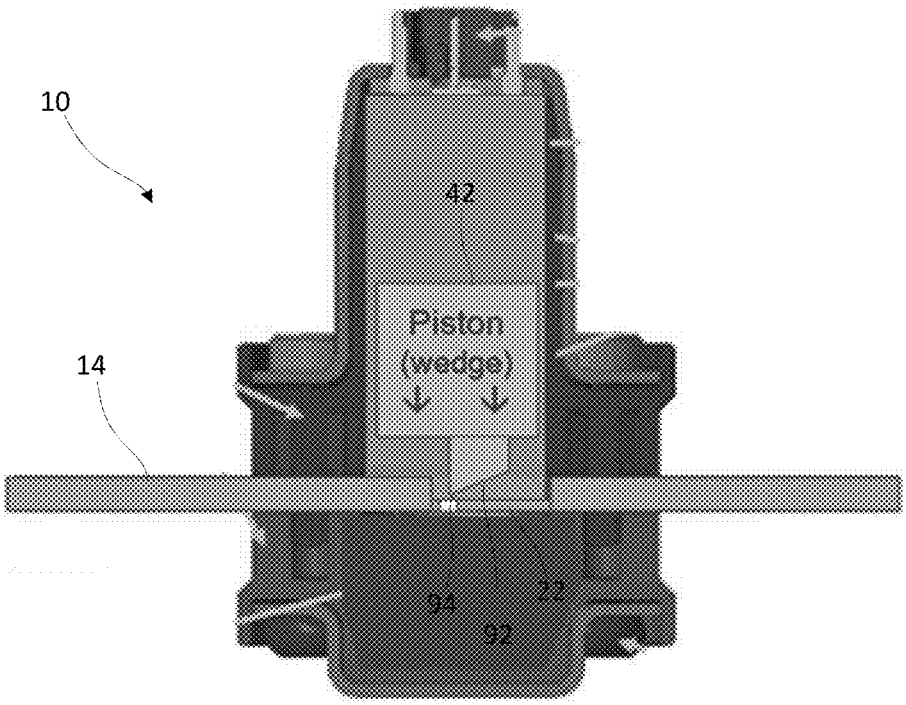
FIG. 6A is a cross sectional view illustrating another embodiment of an active/passive fuse module in accordance with the present disclosure.
Figure 6B:
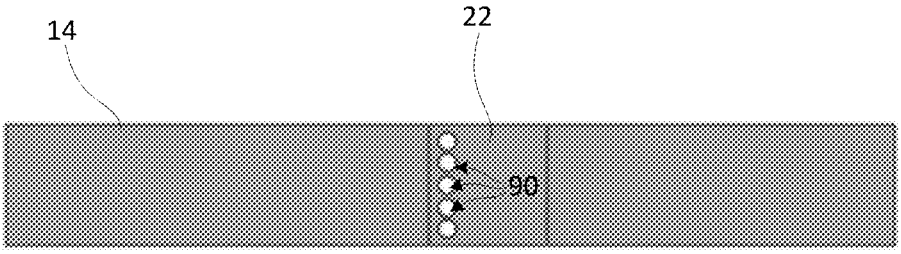
FIG. 6B is a top view illustrating the busbar of the active/passive fuse module shown in FIG. 6A.

Referring to FIG. 6A, another embodiment of the present disclosure is contemplated wherein the fuse element 22 of the busbar 14 may be mechanically weakened for allowing the piston 42 to readily break through the fuse element 22 (various components of the fuse module 10, such as the leads 52*a*, 52*b*, have been omitted form FIG. 6A for the sake of clarity). Specifically, the fuse element 22 may include a plurality of weak points, wherein a geometry of the weak points corresponds to a geometry of the piston 22. For example, referring to the top view of the busbar 14 shown FIG. 6B, the weak points may be a plurality of perforations 90 formed in the fuse element 22, wherein the perforations are arranged in a linear pattern. Referring back to FIG. 6A, the piston 42 may have an angled bottom surface 92 defining a linear, bottom edge 94 that is parallel to and aligned with the linear pattern defined by the perforations 90. Thus, when the piston 42 is deployed and engages the fusible element 22, the bottom edge 94 may readily cut through the narrow portions of the fusible element 22 that bridge the perforations 90, ensuring full separation and breakthrough of the fuse element 22. The piston 42 and the busbar 14 shown in FIGS. 6A and 6B can be implemented in any of the fuse module embodiments shown in FIGS. 1-4, for example.

The above-described shapes, geometries, and configurations of the piston 42 and corresponding weak points in the fuse element 22 are provided by way of example only and can be varied without departing from the scope of the present disclosure. Moreover, the above-described perforations 80 and 90 are merely examples of weak points that can be formed in the fuse element 22. In various embodiments, the weak points may additionally or alternatively include any type of voids or depressions that extend partially or entirely through the fuse element 22. These include, but are not limited to, various types of slots, notches, indentations, cavities, troughs, dimples, etc.

In view of the foregoing description, it will be appreciated that the active/passive fuse modules of the present disclosure facilitate the implementation of both passive and active circuit protection elements (e.g., conventional fuse elements and a pyrotechnic interrupter) in single, compact, space-saving form factor that facilitates convenient installation for various applications.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

While the present disclosure makes reference to certain embodiments, numerous modifications, alterations and changes to the described embodiments are possible without departing from the sphere and scope of the present disclosure, as defined in the appended claim(s). Accordingly, it is intended that the present disclosure not be limited to the described embodiments, but that it has the full scope defined by the language of the following claims, and equivalents thereof.

The invention claimed is:

1. An active/passive fuse module comprising:

an electrically insulating base;

a busbar disposed on a top surface of the electrically insulating-base and comprising a fuse element and first and second terminal portions extending from opposite ends of the fuse element, the fuse element extending over a cavity formed in the top surface of the electrically insulating base and having a plurality of weak points formed therein;

a pyrotechnic interrupter (PI) disposed atop the electrically insulating base, the PI comprising:

a piston disposed within a shaft above the fuse element, the piston having an edge with a geometry that corresponds to a geometry of a pattern defined by the plurality of weak points in the fuse element;

a first pyrotechnic ignitor coupled to a controller, the first pyrotechnic ignitor configured to detonate and force the piston through the fuse element upon receiving an initiation signal from the controller; and a second pyrotechnic ignitor coupled to the busbar by a pair of leads, the second pyrotechnic ignitor configured to detonate and force the piston through the fuse element upon an increase in voltage across the pair of leads;

wherein the pair of leads extend through the shaft and across a path of the piston and are configured to be severed upon detonation of the first pyrotechnic ignitor or upon detonation of the second pyrotechnic ignitor.

2. The active/passive fuse module of claim 1, further comprising a positive temperature coefficient element connected to the busbar electrically in parallel with the fuse element.

3. The active/passive fuse module of claim 2, wherein the positive temperature coefficient element has, within a normal operating temperature range, a resistance that is greater than a resistance of the fuse element.

4. The active/passive fuse module of claim 1, wherein the controller is adapted to send the initiation signal to the first pyrotechnic ignitor upon occurrence of a predefined event.

5. The active/passive fuse module of claim 1, wherein the piston is formed of an electrically insulating material.

6. The active/passive fuse module of claim 1, wherein the first pyrotechnic ignitor and the second pyrotechnic ignitor are disposed in a side-by-side relationship within the shaft.

7. A fuse module comprising:

an electrically insulating base;

a busbar disposed on a top surface of the electrically insulating base and comprising a fuse element and first and second terminal portions extending from opposite ends of the fuse element, the fuse element extending over a cavity formed in the top surface of the electrically insulating base and having a plurality of weak points formed therein;

a pyrotechnic interrupter (PI) disposed atop the electrically insulating base, the PI comprising:

a piston disposed within a shaft above the fuse element, the piston having an edge with a geometry that corresponds to a geometry of a pattern defined by the plurality of weak points in the fuse element; and a pyrotechnic ignitor coupled to the busbar by a pair of leads, the pyrotechnic ignitor configured to detonate and force the piston through the fuse element upon an increase in voltage across the pair of leads;

wherein the pair of leads extend through the shaft and across a path of the piston and are configured to be severed upon detonation of the pyrotechnic ignitor.

* * * * *